United States Patent [19]

Smeller et al.

[11] Patent Number: 4,771,947

[45] Date of Patent: Sep. 20, 1988

[54] LOW ENERGY IRRIGATION DEVICE

[75] Inventors: Donald W. Smeller, Irvine; Stephen H. Govero, Glendora, both of Calif.

[73] Assignee: Rain Bird Sprinkler Mfg. Corp., Glendora, Calif.

[21] Appl. No.: 910,012

[22] Filed: Sep. 22, 1986

Related U.S. Application Data

[63] Continuation-in-part of Ser. No. 690,724, Jan. 21, 1985, abandoned.

[51] Int. Cl.[4] ..... B05B 1/32; B05B 9/00; B05B 15/00; B05B 1/14

[52] U.S. Cl. ..... 239/453; 239/175; 239/542; 239/551; 239/562

[58] Field of Search ..... 239/542, 533.15, 499, 239/524, 533.1, 452, 454, 570, 453, 505, 506, 456, 459, 551, 562, 588, 171, 175, 169

[56] References Cited

U.S. PATENT DOCUMENTS

| | | | |
|---|---|---|---|
| 1,609,863 | 12/1926 | Cowles | 239/453 |
| 1,883,656 | 10/1932 | Estock | 239/542 |
| 2,420,958 | 5/1947 | Landreth | 239/542 |
| 2,521,238 | 9/1950 | McCann | 239/542 |
| 2,529,223 | 11/1950 | Moen | 239/533.1 X |
| 3,032,357 | 5/1960 | Shames et al. | 239/588 X |
| 3,189,283 | 6/1965 | Moore | 239/533.1 X |
| 3,478,967 | 11/1969 | Horton et al. | 239/175 X |
| 3,874,596 | 4/1975 | Baxter | 239/542 |
| 3,958,760 | 5/1976 | Rosenberg | 239/453 |
| 4,194,695 | 3/1980 | Schopp | 239/590.3 X |
| 4,352,462 | 10/1982 | Watanabe et al. | 239/452 X |

FOREIGN PATENT DOCUMENTS

| | | | |
|---|---|---|---|
| 480845 | 12/1969 | Switzerland | 239/505 |
| 673246 | 7/1979 | U.S.S.R. | 239/506 |
| 782766 | 11/1980 | U.S.S.R. | 239/542 |

*Primary Examiner*—Andres Kashnikow
*Assistant Examiner*—Patrick N. Burhhart
*Attorney, Agent, or Firm*—Kelly, Bauersfeld & Lowry

[57] ABSTRACT

An improved irrigation device is provided for precision, relatively low energy and close range delivery of irrigation water to crops and the like with little or no soil erosion. The irrigation device comprises a generally cylindrical body for connection to the lower end of a vertical drop tube adapted for connection in turn to a water supply pipe, for example, of a traveling irrigation system, such as a center pivot or linear system. The cylindrical body carries a downwardly open nozzle for discharge of water into a pressure-regulated chamber defined in part by a funnel-shaped regulator cover slidable about the cylindrical body. The chamber is shaped or otherwise includes means for dissipating a substantial portion of the flow energy of the water discharged into the chamber. Water collecting within the pressure-regulated chamber produces a low pressure head sufficient to float the regulator cover sufficently to create a narrow annular gap through which a thin bubble-like film or curtain of water is emitted at a regulated low pressure for close range delivery into a furrow between adjacent crop rows.

47 Claims, 3 Drawing Sheets

FIG. 1
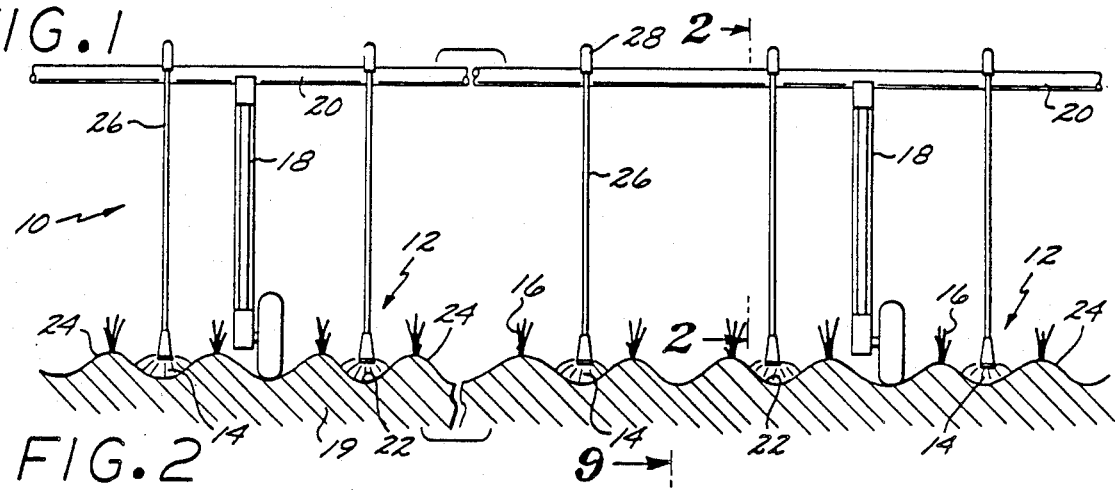
FIG. 2
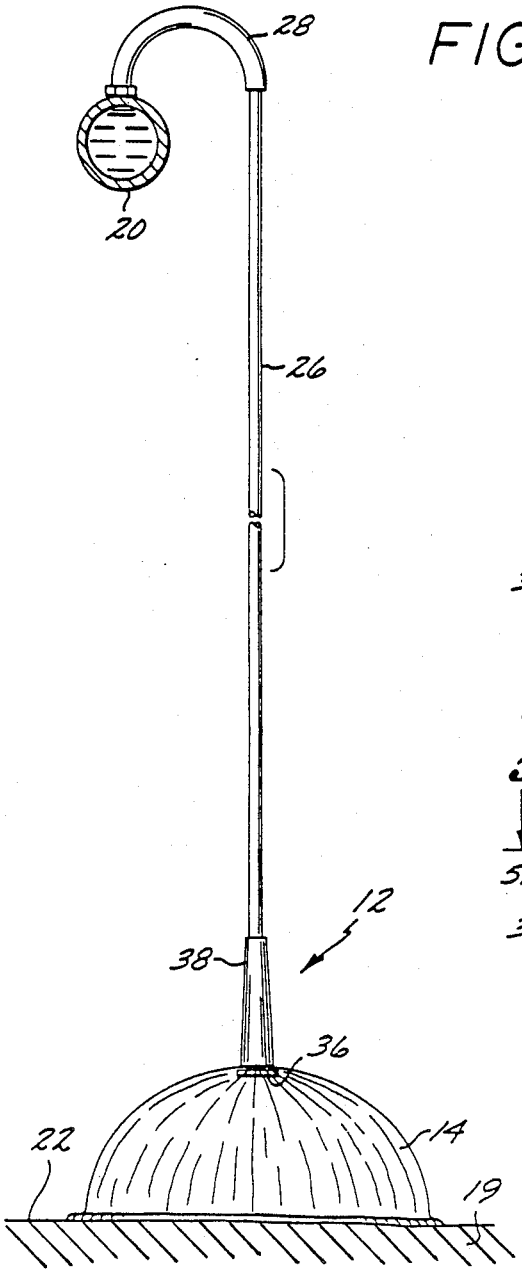
FIG. 3
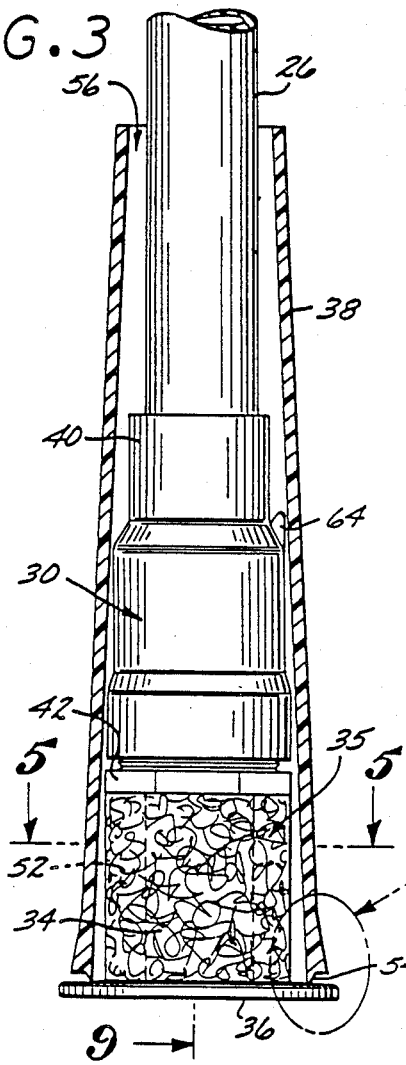
FIG. 4
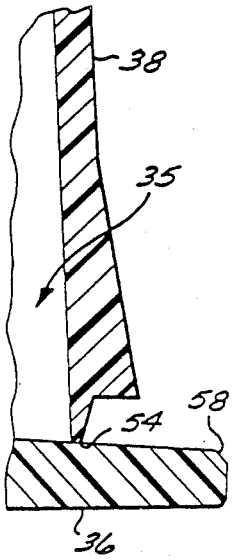
FIG. 5
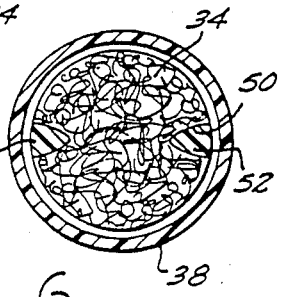
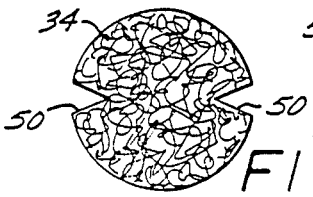
FIG. 6

FIG. 7
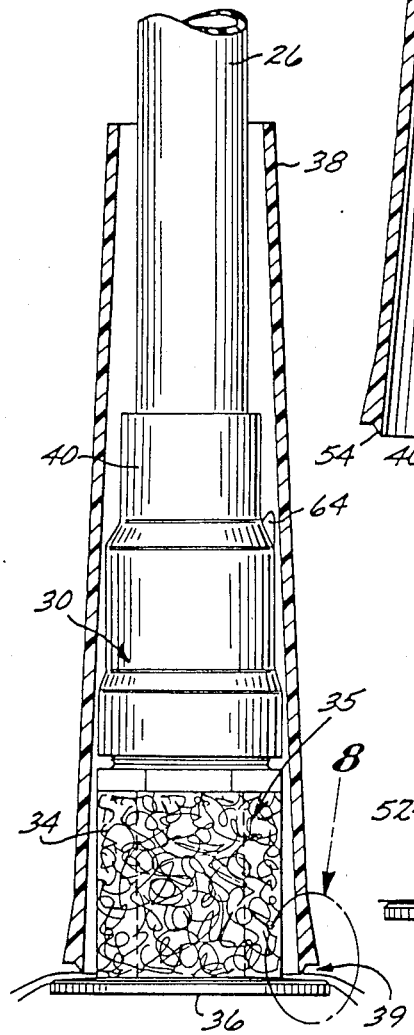
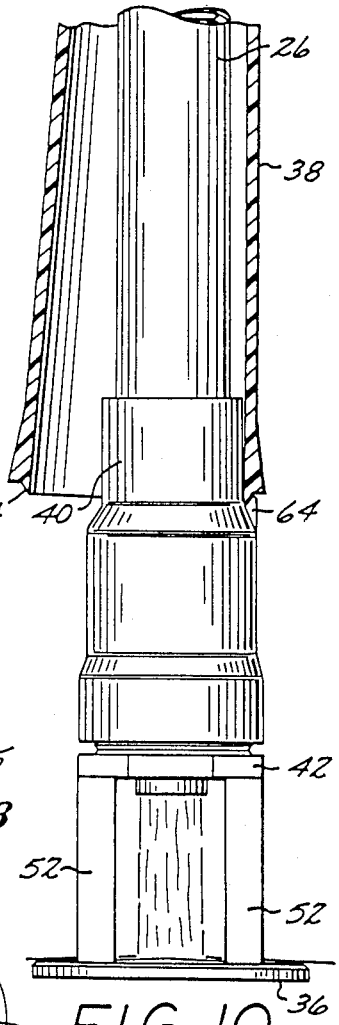
FIG. 10
FIG. 9
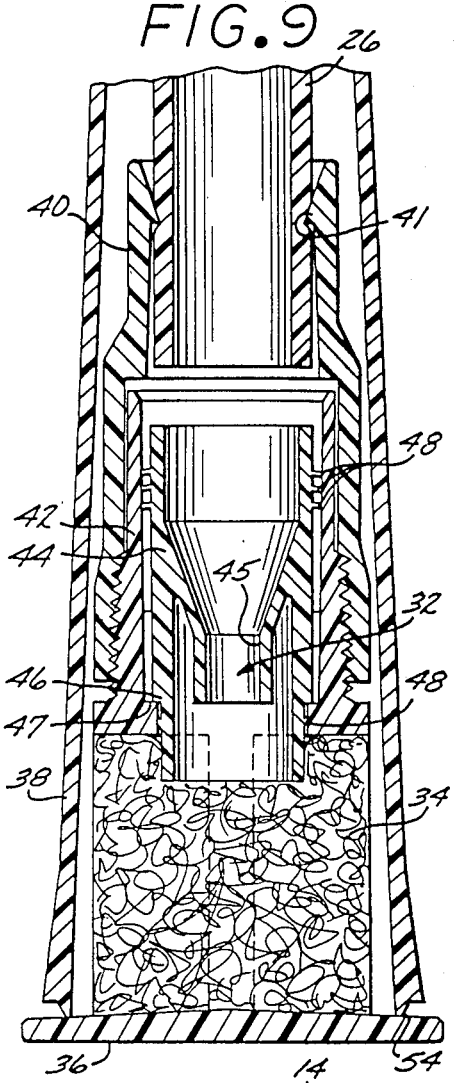
FIG. 8
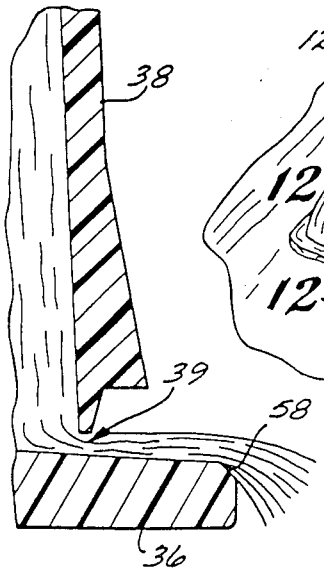
FIG. 11
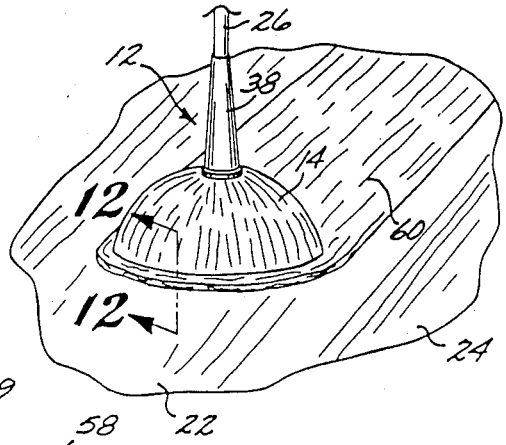
FIG. 12
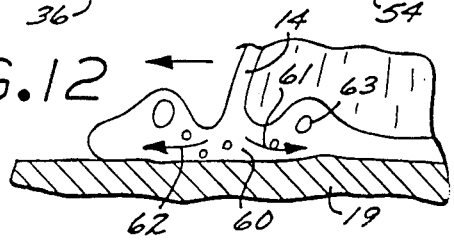
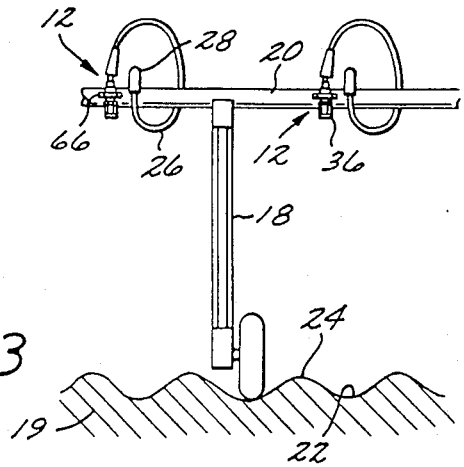
FIG. 13

FIG. 14
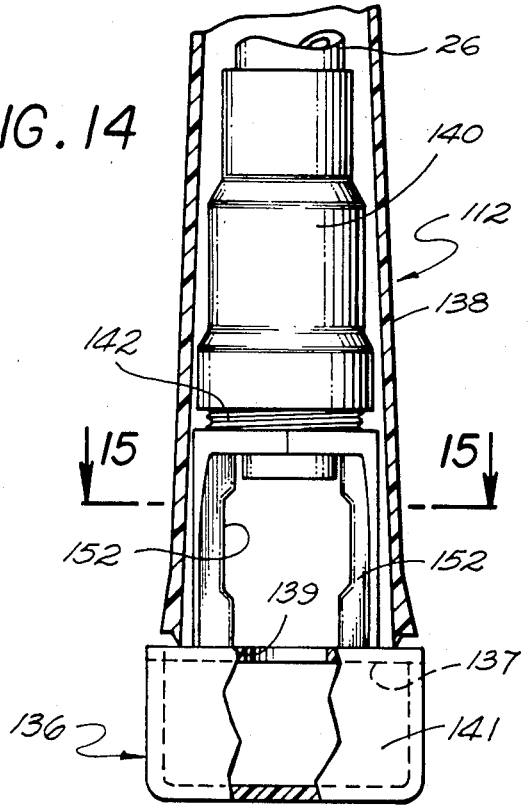
FIG. 15
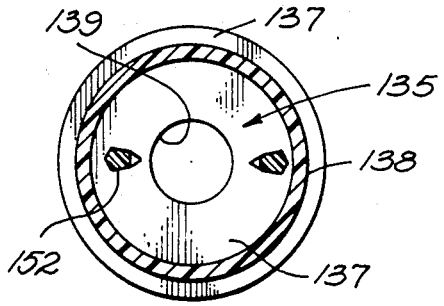
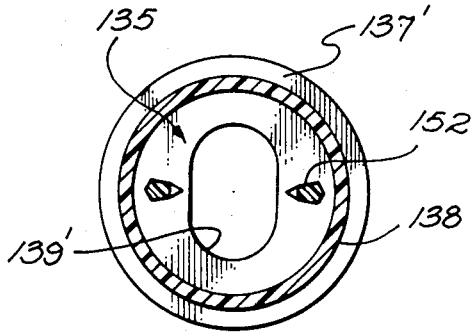
FIG. 16
FIG. 17
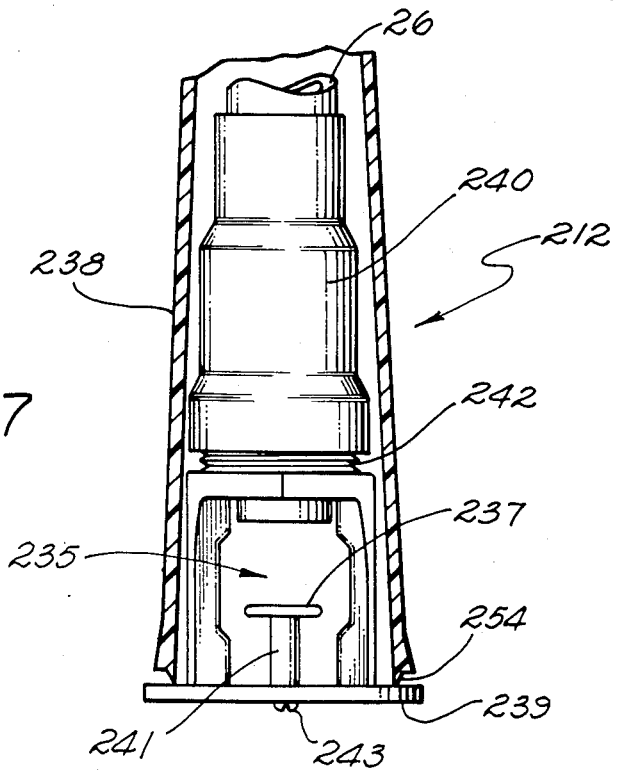

LOW ENERGY IRRIGATION DEVICE

BACKGROUND OF THE INVENTION

This application is a continuation-in-part of copending and commonly assigned application Ser. No. 690,724, filed Jan. 21, 1985, now abandoned.

This invention relates generally to irrigation devices for delivering water to vegetation, such as agricultural crops and the like. More specifically, this invention relates to an improved irrigation device designed primarily for use with traveling agricultural irrigation systems to deliver water to row crops and the like with minimal evaporative and/or windage losses and with minimal soil erosion.

Irrigation devices of many different forms, sizes, and shapes are well known for use in delivering irrigation water to vegetation, such as crops and the like. Such devices have traditionally included a hollow body or housing adapted for connection to a supply of water under pressure and including a nozzle or orifice through which the water is discharged stream or spray is directed or otherwise swept over a prescribed terrain area to provide irrigation water to surrounding vegetation.

In some irrigation systems, particularly for use in an agricultural irrigation environment, the water supply pipe has been mounted on a movable frame for slow travel through an agricultural field, typically by rotation of the frame about a main center pivot or by linear progression as a unit from one side of the field to the other. The movable supply pipe carries a plurality of irrigation devices for delivering water to the crop within the field, thereby permitting irrigation of a large terrain area with a relatively small number of irrigation devices. In most traveling systems, however, the irrigation devices are designed to spray the irrigation water over the crop resulting in relatively high water pumping energy requirements and further resulting in relatively high evaporative losses and uneven water distribution due to windage factors. Other traveling systems have included irrigation devices suspended by drop tubes from the water supply pipe for releasing water near the ground, for example, for close range release into diked furrows between crop rows. While these latter irrigation systems have in some instances reduced evaporative losses and/or reduced undesirable windage effects, significant water pumping energies are still required. Moreover, the close range release of water into diked furrows has been substantially unregulated resulting in uneven water distribution and frequently causing relatively rapid destructive erosion of the water-confining dikes.

There exists, therefore, a significant need for an improved irrigation device for relatively low pressure and relatively precision regulated delivery of irrigation water, particularly at a flow rate accomodating the requirements of a traveling agricultural system. The present system fulfills these needs and provides further related advantages.

SUMMARY OF THE INVENTION

In accordance with the invention, an improved irrigation device provides a relatively low pressure water discharge flow in the form of a thin and substantially bubble-like film or curtain for close range delivery into crop furrows or the like with minimal evaporative and/or windage losses and with little or no soil erosion. The improved irrigation device includes a nozzle through which a stream of water is discharged initially into a pressure regulated chamber. This chamber is shaped or otherwise includes means therein for dissipating or absorbing a substantial portion of the water flow energy prior to discharge from the chamber. The water thus collects within the chamber at low pressure and is subsequently discharged outwardly therefrom through a narrow substantially annular gap with a flow configuration in the form of the thin laminar bubble-like film at a predetermined relatively low pressure.

In one preferred form of the invention, the improved irrigation device is designed particularly for use in a traveling irrigation system of the type including a water supply pipe carried by a wheeled frame such as in a so-called center pivot or linear travel system or the like for movement through an agricultural field. The improved device comprises a generally cylindrical body for connection to the lower end of a drop tube suspended in turn from the water supply pipe, wherein the drop tube advantageously may be formed from a flexible tubing material for maintaining the irrigation device in a substantially vertical orientation. The cylindrical body has the nozzle at its lower end for discharge passage of a stream of water in a downward direction substantially directly into a porous energy-absorbing element supported within the chamber upon an underlying deflector. The drop tube supports the irrigation device with said deflector in close proximity, typically about four inches, from the ground.

A generally funnel-shaped regulator cover is slidable relatively freely about the cylindrical body and cooperates with the deflector to define the pressure-regulated chamber. More particularly, the regulator cover has a diametrically enlarged lower end portion surrounding the energy absorbing element and including a generally annular lower margin for engaging the deflector near the periphery thereof to confine the water discharged through the nozzle within the pressure-regulated chamber. A diametrically smaller upper end of the regulator cover is freely slidable about the cylindrical body at a position above the nozzle with sufficient clearance to define an air vent between the cover and said body.

In use, the water discharged through the nozzle collects within the pressure-regulated chamber to produce a pressure head sufficient to float the regulator cover above the deflector and form a narrow substantially annular gap through which the thin bubble-like water film is emitted at a relatively low pressure regulated in accordance with the shape and mass of the regualtor cover. A peripheral chamfer on the deflector plate can be provided to tailor the direction of water delivery into the crop furrow. Importantly, this bubble-like water film has a strong tendency as a result of fluid surface tension effects to maintain a dome-shaped or bubble-shaped integrity to deposit on the ground softly and without prior breaking up into droplets, thereby minimizing soil erosion and distribution variations due to windage. Moreover, the bubble-like film is achieved at extremely low water supply pressures to significantly reduce pumping energy requirements.

In accordance with further features of the improved irrigation device, the device can be placed in an alternative operational mode for spraying water in droplet form beyond a crop furrow as required, for example, during the germination period of agricultural crop seed. Such alternative operation is achieved by lifting the regulator cover relative to the cylindrical body to an out-of-the-way position above the nozzle with said cover nested upon a retainer tab formed on the cylindrical body. The porous element is then removed to permit water from the nozzle to impact the underlying deflector for spray outwardly in a generally annular pattern of droplets.

In further alternative preferred forms of the invention, the deflector of the irrigation device may be reconfigured to insure flow energy dissipation within the chamber but without requiring use of the porous element. More particulalry, the deflector can be designed to define an outer support seat for supporting the lower margin of the funnel-shaped surface positioned in vertical misalignment with the cover/support seat interface. Water discharged downwardly from the nozzle into the chamber initially strikes the deflector surface and is deflected outwardly therefrom to strike the interior of the regulator cover or other chamber-forming structures without direct passage to the cover-support seat interface. The water is thus required to undergo directional flow changes resulting in significant energy dissipation before discharge passage between the regulator cover and the support seat as a thin bubble-like film at low pressure. In accordance with the specific design, the deflector surface can be disposed vertically above or below the cover/support seat interface, and an inwardly radiating rim can be provided at a location between the deflector surface and the cover/support seat interface for further enhanced energy dissipation.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a fragmented elevation view illustrating portions of an exemplary traveling agricultural irrigation system including a plurality of improved irrigation devices embodying the novel features of the invention;

FIG. 2 is an enlarged fragmented vertical sectional view taken generally on the line 2—2 of FIG. 1 and illustrating one of the improved irrigation devices in operation;

FIG. 3 is an enlarged fragmented elevation view of one of the improved irrigation devices in accordance with one preferred form of the invention, with portions thereof shown in vertical section;

FIG. 4 is an enlarged fragmented vertical section of a portion of the improved irrigation device referred to generally by arrow 4 in FIG. 3;

FIG. 5 is a horizontal section taken generally on the line 5—5 of FIG. 3;

FIG. 6 is a top plan view of a porous energy-absorbing element for use in the improved irrigation device;

FIG. 7 is an enlarged fragmented elevation view generally similar to FIG. 3 but illustrating the irrigation device in operation;

FIG. 8 is an enlarged fragmented vertical section of a portion of the irrigation device referred to generally by arrow 8 in FIG. 7;

FIG. 9 is an enlarged fragmented vertical section taken generally on the line 9—9 of FIG. 3;

FIG. 10 is an enlarged fragmented elevation view of the irrigation device shown in an alternative operational mode and with the porous energy-absorbing element removed, with portions of the device being shown in vertical section;

FIG. 11 is a fragmented perspective view illustrating operation of the improved irrigation device for delivering irrigation water into a crop furrow;

FIG. 12 is an enlarged fragmented and somewhat schematic sectional view taken generally on the line 12—12 of FIG. 11;

FIG. 13 is a fragmented elevation view similar to portions of FIG. 1 but illustrating the improved irrigation devices in the alternative operational mode;

FIG. 14 is an enlarged fragmented elevation view similar to FIG. 3 but depicting an alternative preferred form of the invention, with portions thereof shown in vertical section;

FIG. 15 is a horizontal sectional view taken generally on the line 15—15 of FIG. 14;

FIG. 16 is a horizontal section view similar to FIG. 15 but depicting still another alternative preferred form of the invention; and FIG. 17 is an enlarged fragmented elevation view of still another alternative preferred form of the invention, with substantial portions shown in vertical section.

DETAILED DESCRIPTION OF THE PREFERRED EMBODIMENTS

As shown in the exemplary drawings, an irrigation system referred to generally by the reference numeral 10 includes a plurality of improved irrigation devices 12 embodying the novel features of the invention. As shown in FIG. 1, the improved irrigation devices 12 each deliver a regulated and relatively low pressure substantially bubble-like film or curtain 14 of irrigation water in a close range manner to adjacent vegetation, such as a crop 16.

The improved irrigation device 12 of the present invention is designed particularly for use with a traveling agricultural irrigation system, typically of the so-called center pivot or linear type, as generally depicted in FIG. 1, although other irrigation uses are contemplated. In such traveling irrigation systems, the devices 12 are moved slowly through an agricultural field by appropriate driving (not shown) of a wheeled frame 18 or the like in a manner known to those skilled in the art. This wheeled frame 18 carried a water supply pipe 20 to which irrigation water is supplied under pressure and from which the devices 12 are suspended, as will be described in more detail, to within a few inches from the ground 19. In the preferred use of the invention, the frame 18 moves the irrigation devices 12 through the field typically within about four inches from the ground and along diked furrows 22 between raised crop rows 24 so that irrigation water is delivered directly into the furrows typically at a low flow rate of about 0.5 to 15 gallons per minute and at a relatively low pressure typically about 4 to 20 psi. As shown in FIG. 1, the irrigation devices 12 can be arranged in number and spacing to deliver water to alternate furrows 22, although the number and spacing of the devices can be varied as desired, for example, for delivering water to each furrow.

In the irrigation system 10, the relatively low pressure, close range delivery of irrigation water by the improved devices 12 directly to the furrows 22 advantageously minimizes or eliminates destructive soil erosion and further minimizes the substantial evaporative water waste as occurs with many types of higher pressure spray devices. Moreover, the bubble-like water film 14 produced by each device 12 is substantially self-regulated in pressure without requiring additional pressure regulation devices and is highly resistant to variations in distribution due to windage to insure precision flow rates and uniform water distribution across the field during operation. Still further, these advantages are obtained at relatively low water supply pressures to accommodate a substantial reduction in water pumping energy requirements in comparison with conventional traveling irrigation systems. The improved device provides these features with a construction which is relatively inexpensive to manufacture, easy to assemble, and easy to maintain.

As shown in FIGS. 1 and 2, the illustrative irrigation devices 12 are mounted individually onto the lower ends of a plurality of drop tubes 26 which are suspended in turn from the water supply pipe 20. More particularly, in the illustrative irrigation system, the drop tubes 26 have their upper ends connected to a respective rigid elbow tube 28 of generally U-shaped construction and mounted in an inverted position on the water supply pipe 20 in flow communication therewith. Water under pressure within the supply pipe thus flows through the elbow tubes 28 and further through the drop tubes 26 for delivery into a furrow 22 or the like through the improved irrigation devices 12 which are supported by the drop tubes 26 within a few inches, typically about four inches, above the ground 19. In the preferred form, the drop tubes are formed from a lightweight plastic material, such as polyethylene tubing or the like, having sufficient flexibility to maintain the irrigation devices each in a substantially vertical orientation. However, alternative drop tube configurations, such as rigid tubes and/or a combination of rigid and flexible tubing sections, may be used as desired.

Each of the improved irrigation devices 12 of the present invention comprises, in general terms, a generally cylindrical hollow body 30 supported at the lower end of the associated drop tube 26 and including a downwardly open nozzle 32 (FIGS. 3 and 9) of selected geometry through which irrigation water is discharged at a selected flow rate. This water is discharged into a pressure-regulated chamber 35 defined cooperatively by an underlying deflector 36 and a regulator cover 38 of generally funnel-shaped or truncated conical geometry supported for relatively free sliding motion about the cylindrical body 30. In the illustrative embodiment, the water is discharged substantially directly into a pressure dissipating means such as a porous energy-absorbing element 34 supported on the deflector 36. In operation, element 34 dissipates a substantial portion of the water flow energy, and the water collects within the pressure-regulated chamber ultimately increasing in pressure sufficient to lift or float the regulator cover 38 above the deflector 36, thereby creating a small substantially annular gap 39 (FIGS. 7 and 8) between the cover 38 and the deflector 36 through which the bubble-like film 14 is emitted at low pressure.

More specifically, in accordance with the illustrative form of the invention as shown in FIGS. 3–9, the cylindrical hollow body 30 may be conveniently constructed from a suitable lightweight molded plastic or the like to include an upper connector cap 40 of generally cylindrical shape having an open upper end lined internally by a ramped annular tooth 41 for secure, compression fit reception of and attachment to the lower end of the associated drop tube 26. The lower end of this connector cap 40 is internally threaded for coaxial reception of an externally threaded cylindrical nozzle housing 42 which also may be constructed from lightweight plastic or the like. A cylindrical nozzle fitting 44 of molded plastic or the like has a nozzle passage 45 formed therein of selected geometry and is removably supported within the nozzle housing 42 by means of an enlarged outer shoulder 46 which seats upon an annular nozzle housing seat 47. Peripheral seal rings 48 formed integrally about the nozzle fitting 44 engage the interior of the nozzle housing 42 to confine downward water flow from the drop tube 26 for downward discharge through the nozzle passage 45. Alternatively, if desired, the various components forming the cylindrical body 30 can be of a one-piece or any other construction and other means for connection to the drop tube can be used.

The porous energy-absorbing element 34 is supported on the deflector 36 in a position directly below the nozzle housing 42 for receiving and absorbing or dissipating stream energy from the water discharged through the nozzle passage 45. In the preferred form, this energy-absorbing element 34 comprises a block of a foam or spongelike material of generally open cell construction for passage of water therethrough but having sufficient rigidity to avoid significant structural compression when subjected to water flow from the nozzle 32. One preferred material comprises a relatively flexible polyurethane foam coated with a polyvinylchloride spray, such as that sold by Scott Corporation, Eddystone, Pennsylvania, under the designation SIF-Z-10 PPI. Other porous rigid or flexible spongelike materials including but not limited to spun metal fiber structures are also contemplated.

As shown best in FIGS. 3, 5, and 6, the porous energy-absorbing element 34 has a generally cylindrical shape oriented generally coaxially with the nozzle housing 42 and a height sufficient to fit snugly under slight axial compression between the lower end of the nozzle housing 42 and the top surface of the deflector 36. A pair of peripheral, V-shaped notches 50 are cut vertically into the element 34 for receiving support posts 52 which support the deflector 36 beneath the nozzle 32, wherein the support posts 52 and the deflector 36 are conveniently molded integrally with the nozzle housing 42. Alternatively, shallow vertical slits (not shown) can be formed in the element 34 in lieu of the notches 50 to accommodate the support posts 52, if desired.

The deflector 36 protrudes radially outwardly beyond the periphery of the energy-absorbing element 34 to define an outer seat surface for engagement by the lower end of the regulator cover 38, with said deflector typically having a circular shape to provide a generally annular seat surface geometry, as viewed in the accompanying drawings. This regulator cover 38 is also conveniently formed from lightweight molded plastic and has a generally truncated conical shape extending from a larger diameter lower end upwardly about the cylindrical body to a smaller diameter upper end disposed above the connector cap 40. An annular lower margin 54 of the regulator cover 38 is engageable with or floats slightly above the deflector 36, as will be described in more detail. The remaining portions of the cover 38 are relatively freely slidable up and down about the cylindrical body 30, with the smaller upper end of the cover 38 being sized to provide an air vent 56 between the cover 38 and the body 30.

The regulator cover 38 cooperate with the deflector 36 to define the substantially enclosed yet vented pressure-regulated chamber 35. More particularly, water discharged into the porous energy-absorbing element 34 is thus discharged into and collects within the chamber 35, building to a water level near the upper end of the cover 38. This collected water creates a low-pressure head within the chamber 35 to apply an upward lifting force to the upwardly converging regulator cover 38. This lifting force ultimately increases when the pressure head reaches a predetermined but still relatively low threshold to a magnitude sufficient to lift or float the regulator cover 38 above the deflector 36, resulting in the small substantially annular gap 39 (FIGS. 7 and 8) therebetween through which water escapes from the chamber 35 to maintain chamber pressure substantially constant throughout a broad range of pressure within the water supply pipe 20.

In accordance with a primary feature of the improved irrigation device 12, the water is emitted from the pressure-regulated chamber 35 in the form of the bubble-like film 14. This film 14 comprises a single continuous thin laminar sheet of water which is not broken up or in the form of individual high energy droplets. The structural integrity of this laminar water film 14 is advantageously maintained by readily visible liquid surface tension effects causing the film to fall lightly and as a substantially closed shell onto the ground 19 with minimal soil erosion. These surface tension effects draw the film about the support posts 52 into the closed shell geometry, particularly when those posts are tailored with a suitable streamline cross section to avoid creation of a gap in the water film pattern. Moreover, the shape of the film 14 can be tailored to meet individual irrigation requirements, for example, by inclusion of an upper peripheral chamfer 58 (FIGS. 4 and 8) on the deflector 36 to control the angle of delivery toward the ground, or by tailoring the deflector to an oblong or any other desired shape.

As shown best in FIGS. 2, 11, and 12, the bubble-like film 14 falls upon the ground 19 in a closed geometry, with a circular pattern being shown. When the system is initially turned on, the film 14 contacts the soil directly but lightly to wet the soil in the exemplary circular pattern. However, after this initial contact, a continuous annular puddle 60 (FIG. 12) is created into which the film 14 then falls to flow radially inwardly and radially outwardly, as depicted by arrows 61 and 62. This puddle 60 thus grows in the direction of arrows 61 and 62 faster than the rate of travel of the wheeled frame 18 (FIGS. 1 and 11) whereby the water film 14 falls into the puddle 60 within the furrow 22 and not directly onto the soil 19. In other words, the puddle 60 prewets the soil in advance of the falling film 14 to provide a water cushion for receiving the falling film substantially without any soil erosion. This cushion effect is believed to be enhanced by entrained or compressible air bubbles 63 within the falling film 14 to absorb the albeit small force of the film 14 falling into the puddle 60.

The closed shell shape of the bubble-like film 14 is highly resistant to windage disruption, to deviations of the device from a vertical orientation, or to the soil texture which can be smooth or rough. The surface tension effects of the film 14 cause the film to adhere to the puddle 60 during exposure to wind or during swinging of the drop tube 26 as the wheeled frame moves over irrigation terrain or gravel soil regions.

In accordance with a further aspect of the invention, the irrigation device 12 is adapted for alternative use as a spray device when it is desired to wet the entire surface area of a field, such as during a seed germination period following planting. For such alternative use, the regulator cover 38 can be lifted quickly and easily in an upward direction about the cylindrical body 30 and the lower margin 54 of said cover 38 seated witin an upwardly, outwardly projecting short retainer tab 64 formed on the connector cap 40, as shown in FIG. 10. This lower margin 54 is conveniently configured for secure engagement with the tab 64 to support the cover in an out-of-the-way position above the nozzle 32. The porous energy-absorbing element 34 can then be removed from the deflector 36 so that the water discharged downwardly from the nozzle is diverted radially outwardly in conventional droplet form by the deflector. In this alternative mode, the devices 12 are normally mounted in a temporary higher elevation position typically by clamps 66 of any suitable known design for anchoring the devices 12 onto the water supply pipe 20, as shown in FIG. 13.

After the seed germination period, the devices 12 are rapidly returned to their primary operational mode for close range delivery of water in the bubble-like film 14 to the preformed furrows. Such operation is resumed by releasing the devices 12 from the clamps 66, returning the energy-absorbing elements 34 to position, and freeing the regulator covers 38 from their respective retainer tabs 64.

Alternative preferred configurations for the improved irrigation device of the present invention are shown in FIGS. 14–17, wherein the pressure-regulated chamber is reconfigured to obtain substantial water stream energy dissipation without requiring inclusion of the porous energy-absorbing element 34 described with respect to FIGS. 3–9. In these embodiments of the invention, substantial flow energy dissipation is obtained by requiring multiple water flow directional changes within the pressure-regulated chamber prior to outward discharge beneath the regular cover at low pressure and substantially as a bubblelike film.

More particularly, with reference to FIGS. 14 and 15, an alternative irrigation device 112 is provided for connection, for example, to the lower end of a drop tube 26 or the like as previously described with respect to FIG. 1. The irrigation device 112 includes an upper connector cap 140 for connnection to the drop tube and for receiving a nozzle housing 142 having a nozzle opening therein of selected size for downward discharge of a stream of water. This water stream is discharged from the nozzle directly into a pressure regulated chamber 135 within which the flow energy of the water stream is dissipated.

The pressure-regulated chamber 135 is defined by a regulator cover 138 shown to have a generally funnel-shaped or truncatd conical geometry for relatively free sliding motion about the connector cap 140 and associated drop tube 26, all in the same manner as described previously with respect to FIGS. 3–9. A lower annular margin 154 of this regulator cover 138 normally rests upon an outer support seat of a lower deflector element 136 which cooperates with the cover to enclose the chamber 135. A pair of support posts 152 or the like are connected between the nozzle housing 142 and the deflector element 136.

In the embodiment of FIG. 14, the deflector element 136 is modified from the form shown in FIGS. 3–9 to insure water stream flow energy dissipation without requiring the use of a porous dissipation element. More specifically, the deflector element 136 comprises a generally annular upper ring 137 defining the outer support seat for the cover and joined to the support posts 152. This ring 137 extends radially inwardly beyond the posts to a circular inner margin defining a central opening 139 in general vertical alignment with the downwardly directed water stream. Accordingly, the water stream passes through the opening 139 to fall into a lower cup 141 of the deflector element 136, wherein this cup 141 is supported from the underside of the upper ring 137.

The water falling into the cup 131 initially strikes the bottom wall thereof and is deflected radially outwardly toward the cup outer wall. However, since the cup bottom wall is vertically misaligned below the interface of the regulator cover lower margin 154 and the deflector ring 137, the water cannot discharge from the chamber 135. Instead, the water flow must continue to fill the lower cup 141 at which time the water collects and spills upwardly through the ring opening 139 before flowing outwardly toward the lower margin 154 of the cover. The deflector element 136 therefore requires the water to undergo multiple directional changes within the chamber 135 and further to flow back upon itself through the opening 139 whereby significant flow energy is dissipated from water present at the regulator cover lower margin. This dissipation prevents high pressure or high velocity water discharge beneath the cover 138 but instead causes the water to fill partially within and lift the cover 138 in the same manner described with respect to FIGS. 3–9. The water ultimately discharged beneath the regulator cover 138 is thus discharged substantially as a thin bubble-like film at low pressure.

While the deflector element 136 is shown in FIGS. 14 and 15 to include a circular central opening leading to the underlying cap 141, alternative opening geometries may be employed to achieve enhanced water stream energy dissipation. For example, as viewed in FIG. 16, the deflector element can be modified sligthly to have an upper deflector ring 137' with a generally elliptical central opening 139' formed therein. The elliptical opening is preferrably oriented with its minor axis generally aligned with the support posts 152 and has been found to enhance the low pressure, bubble-like integrity of a water film discharged from the irrigation device.

Another alternative form of the invention is shown in FIG. 17 wherein a modified deflector element 236 includes a centrally located deflector platform 237 in vertical misalignment above the lower margin of a floatable regulator cover 238. More specifically, FIG. 17 depicts a further alternative irrigation device 212 having an upper connector cap 240 for connection between a drop tube 26 and a lower nozzle housing 242 in the same manner described with respect to FIGS. 14–16. A funnel-shaped regulator cover 238 is slidably carried about these components and has a lower annular margin 254 normally rested upon an outer support seat of a circular deflector plate 239 carried at the lower ends of support posts 252 and cooperating with the cover 238 to define a pressure-regulated chamber 235.

Within the pressure-regulated chamber 235, the deflector plate 239 supports the deflector platform 237 in the form of a small circular disk or the like positioned at the upper end of a short post 241 which is secured centrally to the plate 239 by a screw 243 or the like. This platform 237 is thus aligned vertically with the downwardly discharged water stream entering the chamber 235 to deflect the stream radially outwardly. However, this outward deflection occurs at a position misaligned vertically above the lower margin 254 of the regulator cover 238. Accordingly, the water strikes the interior of the cover at a position above the lower margin 254 and thereby changes direction again to fall onto the deflector plate 239. These directional changes are effective to dissipate flow energy from the stream whereby the water partially fills and floats the cover 238 before discharge from the chamber in the desired form of the thin, bubble-like, low pressure film.

The improved irrigation devices of the present invention thus provide simple yet highly effective regulated low pressure mechanisms for close range delivery of irrigation water at low pressure to crops and the like. When the improved device is used, evaporative and windage losses are dramatically reduced and soil erosion is nearly or completely eliminated. Moreover, hydraulic pumping energy requirements are also reduced.

A variety of further modifications and improvements to the improved irrigation device described herein are believed to be apparent to those skilled in the art. Accordingly, no limitation on the invention is intended by way of the foregoing description and the darwings, except as specifically set forth in the appended claims.

What is claimed is:

1. An improved irrigation device, comprising:

a body for connection to a water supply pipe and having a nozzle at one end thereof for discharge of a stream of irrigation water;

a deflector element supported in a spaced relation with said nozzle for deflecting the stream in an outward direction;

pressure regulation means supported by said deflector element and cooperating therewith to define a pressure-regulated chamber having a lower outlet and an upper open vent, said pressure regulation means being movable to open and close said lower outlet and being responsive to water pressure within said chamber at a predetermined pressure level to lift relative to said deflector element to open said lower outlet to permit outward passage of water from said chamber, said pressure regulation means remaining in a position closing said lower outlet when the pressure level within said chamber is below said predetermined pressure level; and said deflector element including means for dissipating a substantial portion of the flow energy of the water stream within said chamber whereby the water is discharged outwardly from said chamber through said lower outlet as a relatively thin bubble-like water film at a relatively low pressure.

2. The improved irrigation device of claim 1 further including means for connecting said body to a water supply pipe in a generally vertical orientation with said nozzle directed generally downwardly for discharge passage of the stream in a downstream direction.

3. The improved irrigation device of claim 2 wherein said connecting means comprises a drop tube.

4. The improved irrigation device of claim 2 wherein said connecting means comprises a flexible drop tube.

5. The improved irrigation device of claim 2 wherein said deflector element comprises a deflection surface for deflecting the stream in at least one direction, said deflection surface being positioned in vertical misalignment relative to a lower margin of said pressure regulation means.

6. The improved irrigation device of claim 2 wherein said pressure regulation means comprises a hollow flow regulator cover of generally truncated conical shape slidably carried about said body and having its larger diameter end thereof sized to seat upon said deflector element in a position circumscribing said chamber.

7. The improved irrigation device of claim 6 wherein said deflector element includes a deflection surface for deflecting the stream generally outwardly and in vertical misalignment relative to the larger diameter end of said cover.

8. The improved irrigation device of claim 7 wherein said deflector surface is positioned vertically below said larger diameter end of said cover.

9. The improved irrigation device of claim 7 wherein said deflection surface is positioned vertically above said larger diameter end of said cover.

10. An improved irrigation device, comprising:

a body for connection to a water supply pipe and having a nozzle at one end thereof for discharge of a stream of irrigation water;

a deflector element supported in a spaced relation with said nozzle for deflecting the stream in an outward direction; and pressure regulation means supported by said deflector element and cooperating therewith to define a pressure-regulated chamber, said pressure regulation means being responsive to water pressure within said chamber at a predetermined pressure level to lift relative to said deflector element to permit outward passage of water from said chamber, said pressure regulation means including a hollow flow regulator cover of generally truncated conical shape slidably carried about said body and having its larger diameter end thereof sized to seat upon said deflector element in a position circumscribing said chamber, said cover having its smaller diameter end open to atmosphere and sized for relatively free sliding movement about said body and to define an air vent between said body and said cover.

11. The improved irrigation device of claim 6 wherein said deflector element comprises a generally annular ring, means for supporting said ring relative to said nozzle whereby said ring defines an outer seat surface for supporting the larger diameter end of said cover, said ring having a generally centrally located opening therein for downward passage of the water stream discharged from said nozzle, and a cup member supported at the underside of said ring and including a bottom wall for deflecting the wall stream outwardly and a side wall for preventing outer water discharge from said cup member, whereby the water stream falls into and fills said cup member to spill upwardly through said central opening before outward passage between said ring outer seat surface and the larger diameter end of said cover.

12. The improved irrigation device of claim 11 wherein said central opening is generally circular in shape.

13. The improved irrigation device of claim 11 wherein said central opening is generally elliptical in shape.

14. The improved irrigation device of claim 13 wherein said support means comprises a pair of support posts connected between said body and said ring, said elliptical opening having its minor axis generally aligned with said posts.

15. The improved irrigation device of claim 6 wherein said deflector element comprises a deflector plate defining an outer seat surface for supporting the larger diameter end of said cover, and a deflector platform supported on said plate at a position vertically above said larger diameter end of said cover.

16. An improved irrigation device for receiving a supply of water from a water supply pipe and for discharging the water at a relatively low pressure, said device comprising:

a generally cylindrical body having one end for receiving the supply of water and an opposite end including a nozzle for discharge passage of a stream of water;

a deflector element supported in a position generally spaced from and disposed generally coaxially with said nozzle, said deflector element having a diametric size greater than the diametric size of said body;

a flow regulator cover of generally truncated conical shape carried about said body and having its larger diameter end sized to seat upon said reflector element and its smaller diameter end relatively freely slidable about said body, said smaller diameter end being open to atmosphere and cooperating with said body to define an air vent; and energy dissipation means within a pressure-regulated chamber defined cooperatively by said cover and said deflector element for dissipating a substantial portion of the water stream flow energy within said chamber by deflecting the water stream at a position vertically misaligned with the larger diameter end of said cover when said body is in a generally vertical orientation for downward stream discharge through the nozzle, said cover being responsive to water pressure within said chamber at a predetermined pressure level to lift relative to said deflector of a generally annular pattern of water as a relatively thin bubble-like water film at a regulated low pressure.

17. An improved irrigation device for connecting to a water supply tube, comprising:

a generally cylindrical connector cap including means for connection to the supply tube;

a generally cylindrical nozzle housing including means for connection to said connector cap at an end thereof generally opposite the supply tube;

a generally cylindrical nozzle fitting having a nozzle passage formed therein for discharge passage of water from the supply tube, said nozzle housing and said connector cap cooperatively and removably supporting said nozzle fitting;

said nozzle housing further including at least one support post projecting outwardly generally in parallel with said nozzle passage and a deflector element carried by said support post for deflecting water discharge through said nozzle passage; and a hollow flow regulator cover of generally truncated conical shape slidably carried about said connector cap and said nozzle housing and having a larger diameter end sized for seating upon said deflector and an opposite smaller diameter end open to atmosphere and sized for relatively free sliding motion about said connector cap and said nozzle housing and to define an air vent;

said cover cooperating with said deflector element to define a pressure-regulated chamber for collecting water discharged through said nozzle passage, said deflector element including means for dissipating a substantial portion of the water stream flow energy within said chamber, said cover being responsive to water pressure within said chamber at a predetermined pressure level to lift relative to said deflector to permit outward passage from said chamber of a thin bubble-like water film.

18. The improved irrigation device of claim 17 wherein said deflector element comprises a generally annular ring, means for supporting said ring relative to said nozzle whereby said ring defines an outer seat surface for supporting the larger diameter end of said cover, said ring having a generally centrally located opening therein for downward passage of the water stream discharged from said nozzle, and a cup member supported at the underside of said ring and including a bottom wall for deflecting the wall stream outwardly and a side wall for preventing outer wall discharge from said cup member, whereby the water stream falls into and fills said cup member to spill upwardly through said central opening before outward passage between said ring outer seat surface and the larger diameter end of said cover.

19. The improved irrigation device of claim 18 wherein said central opening is generally circular in shape.

20. The improved irrigation device of claim 18 wherein said central opening is generally elliptical in shape.

21. The improved irrigation device of claim 17 wherein said deflector element comprises a deflector plate defining an outer seat surface for supporting the larger diameter end of said cover, and a deflector platform supported on said plate at a position vertically above said larger diameter end of said cover.

22. An improved irrigation device, comprising:

a body for connection to a water supply pipe and having a nozzle at one end thereof for discharge of a stream of irrigation water;

a deflector element supported in a spaced relation with said nozzle for deflecting the stream in at least an outward direction;

pressure regulation means supported by said deflector element and cooperating therewith to define a pressure-regulated chamber, said pressure regulation means being responsive to water pressure within said chamber at a predetermined pressure level to lift relative to said deflector element to permit outward passage of water from said chamber;

said deflector element including a generally annular ring, means for supporting said ring relative to said nozzle whereby said ring defines an outer seat surface for supporting said pressure regulation means, said ring having a generally centrally location opening therein for downward passage of the water stream discharged from said nozzle, and a cup member supported at the underside of said ring and including a bottom wall for deflecting the wall stream outwardly and a side wall for preventing outward water discharge from said cup member, said ring projecting radially inwardly relative to said side wall, whereby the water stream falls into and fills said cup member to spill upwardly through said central opening before outward passage between said ring outer seat surface and said pressure regulation means.

23. An irrigation device for distributing water at a relatively low pressure onto a surface to be irrigated from a relatively higher pressure source, said device comprising:

a tubular conduit having an upper inlet end for attachment with the source, and a lower inlet end for discharge of water therefrom; and means defining a chamber adjacent said outlet end and into which water from said conduit is discharged and accumulated, said chamber defining means including a deflector element and means for supporting said deflector element in spaced relation below said outlet end, and means forming an open upper vent, said chamber defining means further including an upstanding, vertically movable wall responsive to the accumulation of water in said chamber to a predetermined level for lifting to form a lower opening in said chamber to discharge water therefrom with relatively low pressure onto the surface to be irrigated, said movable wall closing said lower opening when the accumulation of water in said chamber is below said predetermined level.

24. An irrigation device as set forth in claim 23 wherein said wall comprises a regulator cover of generally truncated conical shape with a larger diameter end extending below said outlet end and a smaller diameter end extending above said outlet end, said smaller diameter end being slidably supported about said conduit for vertical movement and said larger diameter end sized to seat upon said deflector element.

25. An irrigation device as set forth in claim 24 wherein said deflector element comprises a generally annular ring, means for supporting said ring relative to said outlet end whereby said ring defines an outer seat surface for supporting the larger diameter end of said cover, said ring having a generally centrally located opening therein for downward passage of the water stream discharged from said outlet end, and a cup member supported at the underside of said ring and including a bottom wall for deflecting the wall stream outwardly and a side wall for preventing outer water discharge from said cup member, whereby the water stream falls into and fills said cup member to spill upwardly through said central opening before outward passage between said ring outer seat surface and the larger diameter end of said cover.

26. An irrigation device as set forth in claim 24 wherein said deflector element comprises a deflector plate defining an outer seat surface for supporting the larger diameter end of said cover, and a deflector platform supported on said plate at a position vertically above said larger diameter end of said cover.

27. For use in a travelling irrigation system of the type having an elongated, generally horizontally disposed water supply pipe elevated above and supported for movement over a surface to be irrigated, at least one drop tube coupled with and projecting downwardly of the supply pipe for directing water from a supply pipe downwardly to a position in close proximity with the surface, and distributor means coupled with the lower end of each drop tube for distributing water therefrom onto the surface, the improvement wherein said distributor means comprises:

means defining a chamber within which water is discharged and accumulated from said drop tube, said chamber defining means including a deflector element supported in space relation below the lower end of the drop tube, said chamber having an opening in the upper portion thereof for venting the chamber to atmosphere; and said chamber defining means further including means responsive to the accumulation of water to a predetermined level within said chamber for forming an opening in the lower portion thereof to release water therefrom at a controlled rate onto the surface, said means closing said opening when the accumulation of water within said chamber is below said predetermined level.

28. The improvement as set forth in claim 27 further including means within said chamber for dissipating the energy of water discharged into said chamber.

29. An irrigation device as set forth in claim 23 wherein said chamber means further includes means disposed within said chamber below said conduit outlet end for dissipating the energy of the water discharged from said outlet end.

30. An improved irrigation device for receiving a supply of water from a water supply pipe and for discharging the water at a relatively low pressure, said device comprising:

a generally cylindrical body having one end for receiving the supply of water and an opposite end including a nozzle for discharge passage of a stream of water;

a deflector supported in a position generally spaced from and disposed generally coaxially with said nozzle, said deflector having a diametric size greater than the diameter size of said body;

a porous energy-absorbing element retained between said nozzle and said deflector; and a flow regulator cover of generally truncated conical shape carried about said body and having its larger diameter end sized to seat upon said deflector and its smaller diameter end relatively freely slidable about said body, said smaller diameter end being open to atmosphere and cooperating with said body to define an air vent;

said energy-absorbing element being for passage of and reduction of the energy level of the stream discharged by said nozzle, said cover cooperating with said deflector when said body is in a generally vertical position with said nozzle opening downwardly to define a vented chamber circumscribing said element and into which water is discharged and accumulated from said nozzle, said cover being responsive to the accumulation of water to a predetermined level within said chamber to lift relative to said deflector to define therebetween a generally annular gap permitting discharge of a generally annular pattern of water as a relatively thin bubble-like water film at low pressure.

31. The improved irrigation device of claim 30 further including a drop tube for connecting said body to the water supply pipe.

32. The improved irrigation device of claim 30 wherein said porous energy-absorbing element is formed from a foam material.

33. The improved irrigation device of claim 30 wherein said porous energy-absorbing element is removable.

34. The improved irrigation device of claim 30 wherein said cover is formed from a lightweight plastic.

35. The improved irrigation device of claim 30 wherein said deflector has a chamber formed about the peripheral edge thereof presented toward said nozzle.

36. The improved irrigation device of claim 30 wherein said cylindrical body comprises a generally cylindrical housing and a pair of support posts formed integrally with said housing in positions projecting generally away from said nozzle, said deflector being formed integrally with said support posts and joined thereto near the periphery of said deflector.

37. An improved irrigation device for connecting to a water supply tube, comprising:

a generally cylindrical connector cap including means for connecting to the supply tube;

a generally cylindrical nozzle housing including means for connection to said connector cap at an end thereof generally opposite the supply tube;

a generally cylindrical nozzle fitting having a nozzle passage formed therein for discharge passage of water from the supply tube, said nozzle housing and said connector cap cooperatively and removably supporting said nozzle fitting;

said nozzle housing further including at least one support post projecting outwardly generally in parallel with said nozzle passage and a deflector carried by said support post for deflecting water discharge through said nozzle passage;

a porous energy-absorbing element retained between said nozzle housing and said deflector for passage and diffusion of water discharged through said nozzle passage; and a hollow flow regulator cover of generally truncated conical shape slidably carried about said connector cap and said nozzle housing and having a larger diameter end sized for seating upon said deflector and an opposite smaller diameter end for relatively free sliding motion about said connector cap and said nozzle housing, said smaller diameter end of said cover being open to atmosphere and cooperating with said connector cap and said nozzle housing to define an air vent;

said cover cooperating with said deflector to define a vented chamber with said energy-absorbing element therein and into which water discharged through said nozzle passage is accumulated, said cover being responsive to the accumulation of water to a predetermined level within said chamber to lift relative to said deflector to permit outward passage from said chamber of a thin bubble-like water film.

38. An irrigation device for distributing water at a relatively low pressure onto a surface to be irrigated from a relatively higher pressure source, said device comprising:

a tubular conduit having an upper inlet end for attachment with the source, and a lower outlet end for discharge of water therefrom; and means defining a chamber vented to atmosphere adjacent said outlet end and into which water from said conduit is discharged and accumulated, said chamber means including an upstanding, vertically movable wall responsive to the accumulation of water therein to a predetermined level for lifting to form an opening in said chamber to discharge water therefrom with relatively low pressure onto the surface to be irrigated, said movable wall closing said opening when the accumulation of water in said chamber is below said predetermined level;

said chamber means further including a porous energy-absorbing element disposed within said chamber below said conduit outlet end for diffusing the energy of the water discharged from said outlet end wherein said chamber defining means further includes a deflector and means for supporting said deflector in spaced relation below said outlet end, said porous energy-absorbing element being positioned between said deflector and said outlet end.

39. An irrigation device as set forth in claim 38 wherein said wall has a generally truncated conical shape with a larger diameter end extending below said outlet end and a smaller diameter end extending above said outlet end, said smaller diameter end being slidably supported about said conduit for vertical movement and said larger diameter end sized to seat upon said deflector.

40. An irrigation device as set forth in claim 39 wherein said smaller diameter end is open to atmosphere and sized relative to said conduit to form an air vent between said wall and said conduit.

41. An irrigation device as set forth in claim 40 wherein said outlet end includes a flow restricting nozzle.

42. An irrigation device as set forth in claim 40 wherein said wall is formed of plastic.

43. An irrigation device as set forth in claim 39 wherein said outlet end includes a nozzle.

44. An irrigation device as set forth in claim 43 wherein said nozzle is removably carried by said outlet end.

45. An irrigation device as set forth in claim 41 wherein said deflector is a generally circular disk and said supporting means comprises a pair of support posts connected between said conduit and said deflector at respective, generally diametrically opposed positions near the periphery of said deflector, said porous energy-absorbing element having a pair of upstanding grooves formed in the periphery thereof for receiving said support posts.

46. An irrigation device as set forth in claim 45 wherein said nozzle is removably carried by said outlet end.

47. An improved irrigation device, comprising:

a body for connection to a water supply pipe having a nozzle at a lower end thereof for downward discharge of a stream of irrigation water;

a deflector element supported in a spaced relation below said nozzle for deflecting the stream in at least an outward direction; and pressure regulation means including a vertically movable wall supported by said deflector element and cooperating therewith to define a pressure-regulated chamber having an upwardly open vent, said pressure regulation means being responsive to water pressure within said chamber at a predetermined pressure level to lift relative to said deflector element to permit outward passage of water from said chamber;

said deflector element including a deflector plate defining an outer seat surface for supporting a lower end of said pressure regulation means, and a deflector platform supported on said plate and defining a deflection surface at a position vertically misaligned with respect to said outer seat surface.

* * * * *

UNITED STATES PATENT AND TRADEMARK OFFICE

CERTIFICATE OF CORRECTION

PATENT NO. : 4,771,947

DATED : 9/20/88

INVENTOR(S) : Donald W. Smeller, et al.

It is certified that error appears in the above-identified patent and that said Letters Patent is hereby corrected as shown below:

Col. 1, line 22, after "is discharged" and before "stream or spray", insert ---as a pressurized stream or spray. This discharged---.

Col. 3, line 13, after "funnel-shaped" and before "surface positioned", insert ---regulator cover, in combination with a deflector---.

Col. 12, line 34, after "deflector" and before "of a generally", insert ---to define a generally annular gap permitting discharge---.

Col. 17, line 26, delete [41] and insert ---38---.

Signed and Sealed this

Seventh Day of March, 1989

*Attest:*

*Attesting Officer*

DONALD J. QUIGG

*Commissioner of Patents and Trademarks*